United States Patent [19]

Bianchi

[11] 4,096,810

[45] Jun. 27, 1978

[54] DEVICE FOR VARYING THE POCKET LENGTH PROVIDED ON SEWING MACHINES FOR MAKING WELTED POCKETS

[75] Inventor: Nereo Bianchi, Pavia, Italy

[73] Assignee: NECCHI Societa per Azioni, Pavia, Italy

[21] Appl. No.: 725,416

[22] Filed: Sep. 21, 1976

[30] Foreign Application Priority Data

Oct. 3, 1975 Italy ..... 42907 A/75

[51] Int. Cl.[2] ..... D05B 3/10

[52] U.S. Cl. ..... 112/65; 112/121.15

[58] Field of Search ..... 112/65, 70, 74, 264, 112/121.11, 121.12, 121.15

[56] References Cited

U.S. PATENT DOCUMENTS

| | | | |
|---|---|---|---|
| 2,573,359 | 10/1951 | Rich | 112/65 |
| 3,653,345 | 4/1972 | Bianchi | 112/65 |
| 3,745,946 | 7/1973 | Bianchi | 112/65 |

OTHER PUBLICATIONS

Reece Series PW, Pocket Welting Machine, 2nd Edition; The Reece Corp., pp. Cover & 21; Feb. 1965.

*Primary Examiner*—H. Hampton Hunter

*Attorney, Agent, or Firm*—Stevens, Davis, Miller & Mosher

[57] ABSTRACT

A device for varying the pocket length provided on sewing machines for making welted pockets comprising a bed, a standard, an arm, a head, two groups with adjustable positioning carrying a mounting for driving valves and a mounting for one of two patch turners, frames for carrying the valves and the patch turner movable relative to the groups, pneumatic cylinders fixed to the groups to move the frames to two extreme positions, corresponding to the two extreme operating positions of the pneumatic cylinders and lock blocks positioned intermediate the extreme positions to stop movement of the frames intermediate the extreme positions. The lock blocks are fixed to the end of a piston rod mounted in a cylinder.

2 Claims, 3 Drawing Figures

DEVICE FOR VARYING THE POCKET LENGTH PROVIDED ON SEWING MACHINES FOR MAKING WELTED POCKETS

The present invention relates to a device for varying the length of a pocket applied to sewing machines for making welted pockets. This type of sewing machine comprises a work plate slidable along the longitudinal axis of the machine, a work clamp movable with the work plate to secure on it a piece of the basic fabric, a pair of spaced pressers movable longitudinally with the work place and laterally at a given time, and a fixed center blade, said pressers being provided for positioning a patch of fabric over said basic fabric and after a suitable folding a pair of needles moving together with the work plate to form on the fabrics two parallel longitudinal stitchings, a cutter movable with the needles to cut a slit in the fabrics parallel to the stitchings, patch turners and tab slit cutters to work on the fabrics at the opposite ends of the stitchings.

In such sewing machines as widely described in U.S. Pat. No. 3,653,345 the different length sizes of the pockets are obtained by varying manually everytime the position of one of the two patch turners relative to the other and, at the same time, the position of a mounting of some valves which, in their end sewing position, control the machine lock, when actuated by a work carrying truck along its feeding stroke.

For this purpose, the mounting of valves and one of the patch turners are placed on two elements provided with slidable blocks slidable in a guide carrying a graduated scale and placed on the bed of the sewing machine. The blocks are provided with an index marking on the scale the size of the pocket to be sewn.

A technician, one having decided the length of the pocket to be sewn, places these groups in the position corresponding to the length.

This maneuver is not simple and requires some time. The purpose of the present invention is to enable the operator to select, simply and quickly the size of the pocket length.

The technical problem to be solved was to provide means to cause the displacement of the groups to selectable positions and permit direct operation by the operator through the simple pushing of a selecting pushbutton. The solution of the technical problem disclosed is characterized in that the patch turner and the valves are placed onto frames supported by and movable relative to two blocks owing to pneumatic motors actuated by push buttons and fastened to the blocks, to be prearranged in two extreme positions, corresponding to the two operating conditions of the motors, and in an intermediate position determined by the interference of a lock means with the movable frames. In such a way, it is possible, for each setting of said blocks, to obtain three different sizes of pocket merely by pressing three push-buttons provided on the machine control panel.

Futher advantages and features will be apparent from the description of a preferred embodiment of the device of the present invention and from the accompanying drawings, in which.

Figure 1:
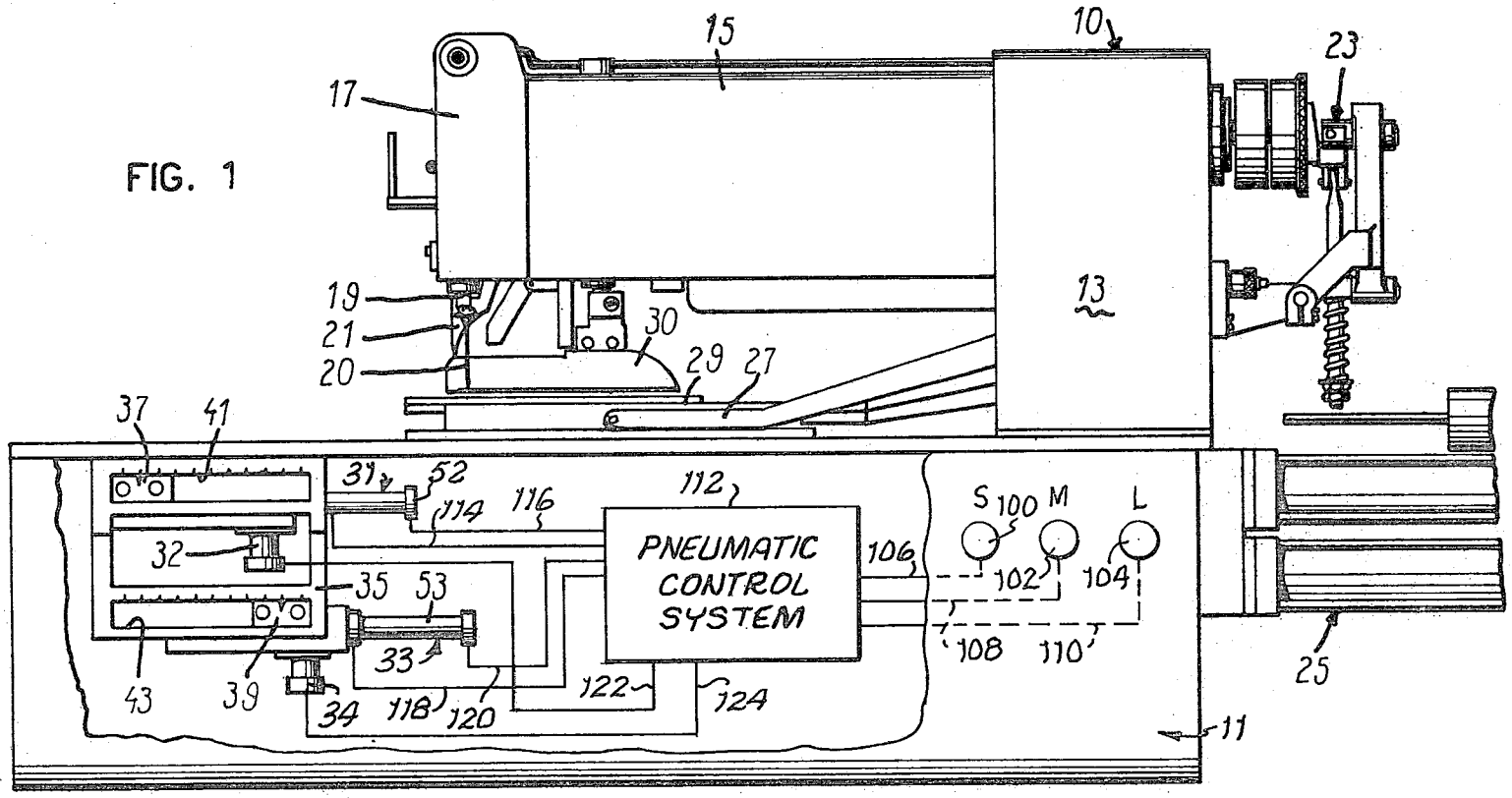
FIG. 1 shows a complete view of the sewing machine and the device of the present invention arranged thereon.

With reference to FIG. 1 a sewing maching for making welted pockets has been generally designated as 10. It is formed by a bed 11, a standard 13, an arm 15 and a head 17. From the lower portion of head 17 two needle bars 19 project, superimposed one on the other in the drawing, and provided with their respective needles 20 to execute two parallel seams and a cutter 21 suitable to cut the fabric equidistant between the two seams.

As a sewing machine of this type has been described in detail in U.S. Pat. No. 3,653,345, only its parts and devices will be illustrated that are in any way connected in operation to the device of the invention.

The machine 10 is further provided with a work plate 9 positioned on the bed 11 for longitudinal sliding movement, driven and controlled by means 25.

Figure 2:
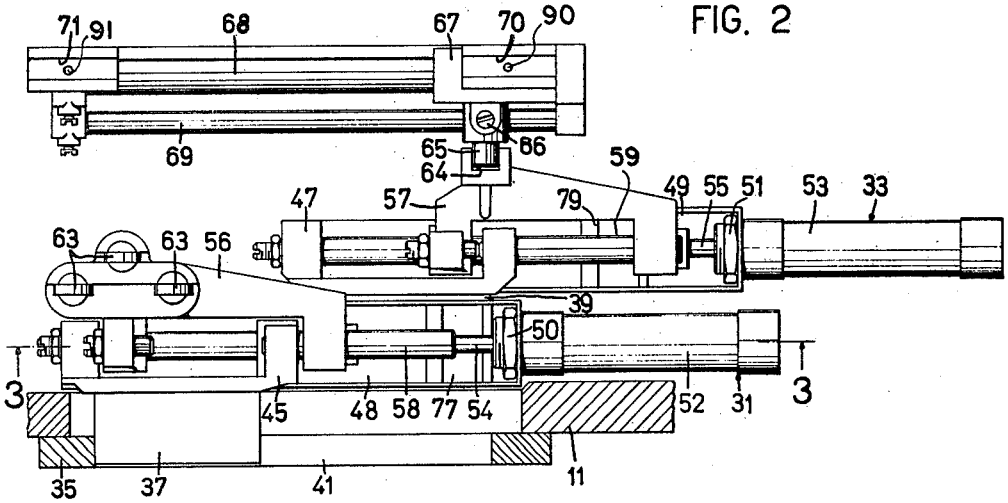
FIG. 2 shows in detail the device of FIG. 1.
Figure 3:
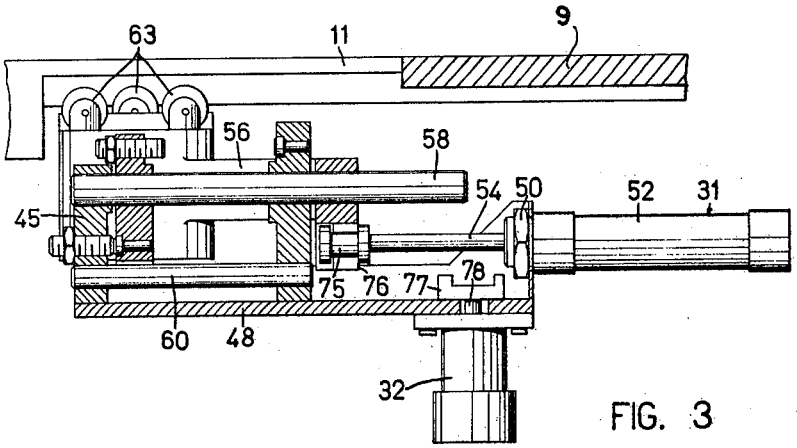
FIG. 3 shows a sectional view of a member of the device taken along the line 3—3 of FIG. 2.

Lock system 23 of sewing machine 10, work presser frame 27, side pressers 29 and center blade 30 are not described because they are not an essential part of the present invention. They have been shown in detail in U.S. Pat. No. 3,653,345. According to the present invention, there are two groups 31 and 33 in bed 11 provided for adjusting the seam length and the corresponding distance of the patch turners respectively. Groups 31 and 33 comprise blocks 37 and 39 which can slide in guides 41 and 43 of frame 35 fixed to bed 11 of the sewing machine. Groups 31 and 33 further comprise elements shown in FIGS. 2 and 3 connected to the blocks 37, 39 in the way hereinafter described. With reference to FIGS. 2 and 3, blocks 37 and 39 are fixed to brackets 45 and 47 respectively, which are fixed in turn to mountings 48 and 49 carrying cylinders 32 and 34 (FIGS. 1 and 3) whose function will be shown hereinafter. At one end of mountings 48 and 49 are fixed, by means of nuts 50 and 51, pneumatic cylinders 52 and 53 whose piston rods 54 and 55 are connected through their free ends to frames 56 and 57 which can slide along a first pair of guides 58 and 59 (not shown) journaled respectively by brackets 45 and 47.

In order to avoid axial revolutions of frames 56 and 57 around guides 58 and 59, there are provided two auxiliary guides which in FIG. 3 is represented only as guide 60 of frame 56.

Guide 60 is parallel to guide 58 and is fixed to bracket 45.

Valves 63 are fastened to frame 56 (FIGS. 2 and 3) and are placed just under the top of bed 11 in order to be operated by the work plate 9 during its longitudinal displacement and to stop the machine in a preselected position. These valves, as described more in detail later, can be positioned in different ways along the path of said work plate 9 in such a way to determine different pocket sizes (see cited U.S. patent).

Provided on frame 57 is guide 64 in which pin 65 is fixedly engaged, by means of a screw 66, to a member 67 axially slidable along guide shaft 68 and prevented from axial revolutions by a shaft 69 parallel to shaft 68.

A mounting 70 is positioned on member 67 and one patch turner 90 is fixed onto mounting 70.

The other patch turner 91 is fixed to mounting 71 fixed to guide 68 and free to displace vertically together with mounting 70 by means of a kinematic chain not shown but widely described in U.S. Pat. No. 3,653,345.

The operator who prepares the machine, to begin the working of a pocket of a determined length, displaces blocks 37 and 39 along their respective guides 41 and 43 as far as, on the proper graduated scale, the size chosen can be read. On the machine control panel three push-buttons S, M, L, are provided, allowing the selection of three different pocket sizes. One of these sizes the central one corresponds to the value chosen through the operator's manual operation, the other have values close and opposite to the one selected manually. These pocket sizes will be called hereinafter long size, medium size and small size.

In order to obtain a long size pocket, push button actuated valve 100 sending a singal to pneumatic control system 112 is manually operated and changes over. Through the pneumatic control system 112 the pressure in ducts 122 and 124 is released so that the pistons of cylinders 32 and 34 are retracted by a force applied by a return spring not shown.

In the meanwhile through pressure in duct 114 and exhaustion in duct 116, the piston of cylinder 52 is set into forward movement and through pressure in duct 118 and exhaustion in duct 120 the piston of cylinder 53 is retracted.

By these positions of the pistons of cylinders 52 and 53, valves 63 and patch turner 90, a long size pocket may be sewn.

In order to obtain a medium size pocket, valve 102 is manually operated and actuated to send a signal through duct 108 to pneumatic control system 112. The control system in turn pressurizes duct 116, exhausts duct 114, pressurizes duct 120, exhausts duct 118 and pressurizes ducts 116 and 124 to cause the piston of cylinder 52 to retract, the piston of cylinder 53 to extend and the pistons of cylinders 32 and 34 to move to their extended position, overcoming the spring forces. Consequently lock blocks 77 and 79 (FIGS. 2, 3) are placed into interference with the path of wall 76 of frame 56 and of the corresponding one of frame 57 not shown in the FIGS. 2 and 3.

During the strokes of piston rods 54 and 55 (FIGS. 2, 3) wall 76 and the corresponding one of frame 57 interfere with lock blocks 77 and 79. Valves 63 and patch turner 90 are stopped in a position corresponding to the sewing of a medium size pocket.

For the execution of a small size pocket just after a medium pocket has been carried out, in order to avoid difficulty in the disengagement of lock block 77 from wall 76 (FIG. 3) due to the pressure of said wall against said lock block, in group 31, instead of passing directly to the position corresponding to the execution of a small size pocket, valves 63 and patch turner 90 move first in the long size pocket position. The same can be said for the group 33.

The push-button valve 100 is pressed and actuated by the operator to send a signal through duct 106 to the pneumatic control system 112. This actuates valve 104 with the results as stated heretofore with the sewing of a long size pocket.

When, at the end of its stroke, i.e., the piston of cylinder 53 is retracted, frame 57 actuates a signal to cause the reversal of the piston of cylinder 52 and the extension of the piston of cylinder 53.

Patch turner 90 and valves 63 come, at last, to the position corresponding to the execution of a small size pocket.

What is claimed is:

1. In a device for varying the pocket length provided on sewing machines for making welted pockets comprising a bed, a mounting, an arm and a head, two groups with adjustable positioning carrying a mounting for driving valves and a mounting for one of the patch turners, the improvement comprising frames for carrying said valves and patch turner movable relative to said groups, a pneumatic cylinder fixed to each of said groups to move said frames to two extreme positions, corresponding to the two extreme operating positions of said cylinders and defining two sizes of pockets and lock means positioned intermediate said extreme positions to define a pocket size intermediate the other two.

2. The device according to claim 1, wherein said lock means are formed by cylinders carrying piston rods fixedly mounted onto said groups and carrying, at the end of their piston rod, lock blocks provided to interfere, in an operative position of said cylinders, with said frames during the displacements of said frame operated by said pneumatic cylinders.

* * * * *